US010196183B2

(12) United States Patent
Chen

(10) Patent No.: US 10,196,183 B2
(45) Date of Patent: Feb. 5, 2019

(54) FASTENER CONTAINER

(71) Applicant: CHENG YU ENTERPRISES CO., LTD., Tainan (TW)

(72) Inventor: Min-Chien Chen, Tainan (TW)

(73) Assignee: Yi-Hsin Chen, Kaohsiung (TW)

( * ) Notice: Subject to any disclaimer, the term of this patent is extended or adjusted under 35 U.S.C. 154(b) by 105 days.

(21) Appl. No.: 15/341,946

(22) Filed: Nov. 2, 2016

(65) Prior Publication Data

US 2018/0118422 A1 May 3, 2018

(51) Int. Cl.
*B65D 43/16* (2006.01)
*B65D 43/02* (2006.01)
*B25H 3/02* (2006.01)

(52) U.S. Cl.
CPC ..... *B65D 43/161* (2013.01); *B25H 3/02* (2013.01); *B65D 43/0212* (2013.01)

(58) Field of Classification Search
CPC ..... B65D 43/161; B65D 43/0212; B25H 3/02
USPC ..... 220/826
See application file for complete search history.

(56) References Cited

U.S. PATENT DOCUMENTS 3,421,654 A * 1/1969 Hexel ..... B65D 43/161 206/508
4,143,695 A * 3/1979 Hoehn ..... A45C 11/20 220/215
4,366,915 A * 1/1983 Seidler ..... A45C 11/24 206/1.5
5,190,152 A * 3/1993 Smith ..... B42F 15/0094 206/425
7,165,695 B2 1/2007 Choi
2005/0236465 A1* 10/2005 Stevens ..... B65D 43/0222 229/125.05
2006/0151512 A1* 7/2006 Van Heugten ..... B65D 43/161 220/826
2007/0131701 A1* 6/2007 Herbert ..... B65D 21/0233 220/826
2011/0024421 A1* 2/2011 Luburic ..... B65D 25/32 220/265
2012/0279969 A1* 11/2012 Antal, Sr. ..... B65D 43/161 220/315

* cited by examiner

*Primary Examiner* — James N Smalley
(74) *Attorney, Agent, or Firm* — J.C. Patents

(57) ABSTRACT

The fastener container in the present invention includes a lid and a receptacle base as main components combined together. Said lid has a first section and a second section which are connected by a hinge, two engaging members are separately provided on both ends of said first section, and a positioning protrusion is set on the inner surface of the end of each engaging member. An engaging circumference is set on the top of the receptacle base, a pair of first positioning notches are symmetrically provided above the both sides of the engaging circumference, and at least one second positioning notch(s) is/are separately provided on the rear side of each first positioning notch. Therefore, this invention allows the user to easily open or close the first section of the lid, but also effortless to hold the first section of the lid in any open angle to allow the user to take or place screws or other items.

13 Claims, 9 Drawing Sheets

FASTENER CONTAINER

BACKGROUND OF THE INVENTION

1. Field of the Invention

This invention relates to a fastener container, particularly to a container having a first section of the lid can be hold in the open position, to facilitate the user to reach his/her hand into the receptacle base to take or put the screws or other items.

2. Description of the Prior Art

The prior art such as U.S. Pat. No. 7,165,695 "Dispensing container for dispensing fasteners" which is consisted of a receptacle base 11 and a lid 23, the lid has a front section 24 and a rear section 25 which are connected by a hinge 26. The rear end of the front section 24 set with a projection portion 50 included a portion of planar upper panel 43 and five inclined, vertical or near vertical panels 52-56. The front end of the rear section 25 set with a socket 51 provided five inclined, vertical or nearly vertical panels 57-62. The surface 53 and 55 carry ribs 63 and 64 to ensure a tight fit that will hold lid front section 24 in the open position.

However, in order to hold the front section 24 of lid 23 in the open position, the user must force the projection portion 50 of front section 24 into the socket 51 of rear section 25. So, if the user presses the front section 24 of lid 23 with excessive force, the lid 23 will be easily separated from the receptacle base 11 or be broken by user. Moreover, the front section 24 of lid 23 can only be held in the maximum open position, it will limit the application of the front section 24 of lid 23, for example, the front section 24 of lid 23 can not be held in an inclined position to prevent the rain or other things fall into the receptacle base 11.

For this reason, the inventor of this invention, having much experience in designing and manufacturing container and its related products, understands and researches the problem of the foregoing prior art and hence devised this invention.

SUMMARY OF THE INVENTION

The objective of this invention is to offer a new fastener container to allow the user to easily open or close the first section of the lid, but also effortless to hold the first section of the lid in any open angle to allow the user to take or place screws or other items.

The fastener container in the present invention includes a lid and a receptacle base as main components combined together. Said lid has a first section and a second section which are connected by a hinge, a side circumferential wall is provided on the periphery of the lid, the side circumferential wall is divided into a first circumferential wall and a second circumferential wall by two symmetrical oblique incision extend from the end of the hinge to the bottom of the side circumferential wall; two engaging members are separately provided on both ends of said first circumferential wall, and a positioning protrusion is set on the inner surface of the end of each engaging member.

The fastener container of present invention, among which said receptacle base has a space and the annular side wall of the receptacle base is provided in conformance with the shape of the lid, an engaging circumference is set on the top of the receptacle base; the front side of said engaging circumference has a first engaging flange, and the rear side of said engaging circumference has a second engaging flange; a pair of first positioning notches are symmetrically provided above the both sides of the engaging circumference, and at least one second positioning notch(s) is/are separately provided on the rear side of each first positioning notch; the second positioning notches and the first positioning notches are arranged in arc, and the position of the first notch is higher than the position of the second notch; the second positioning notch is placed on the outer surface of the engaging circumference.

The fastener container of present invention, among which a protrudent ring is provided between said annular side wall and engaging circumference to strengthen the structure of the receptacle base and to limit the final engaging position and depth of the lid; a pair of symmetrical arc-shaped grooves are provided on both sides of said protrudent ring, said arc-shaped grooves is placed below the first notch and the second notch.

The fastener container of present invention, among which the end of said positioning protrusion may be a convex surface or a flat, and the side of the positioning protrusion may be an oblique plane.

The fastener container of present invention, among which the total length of the first engaging flange is less than the total length of the second engaging flange, so that the first section will be easier to open than the second section.

The fastener container of present invention, among which the plurality of second positioning notches can let the first section of lid to be held in a variety of open angular.

The fastener container of present invention, among which the underside of the first section of the lid may provided with V-shape holder or U-shape holder to utilize the tool holders to receive a variety of fastener tools.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
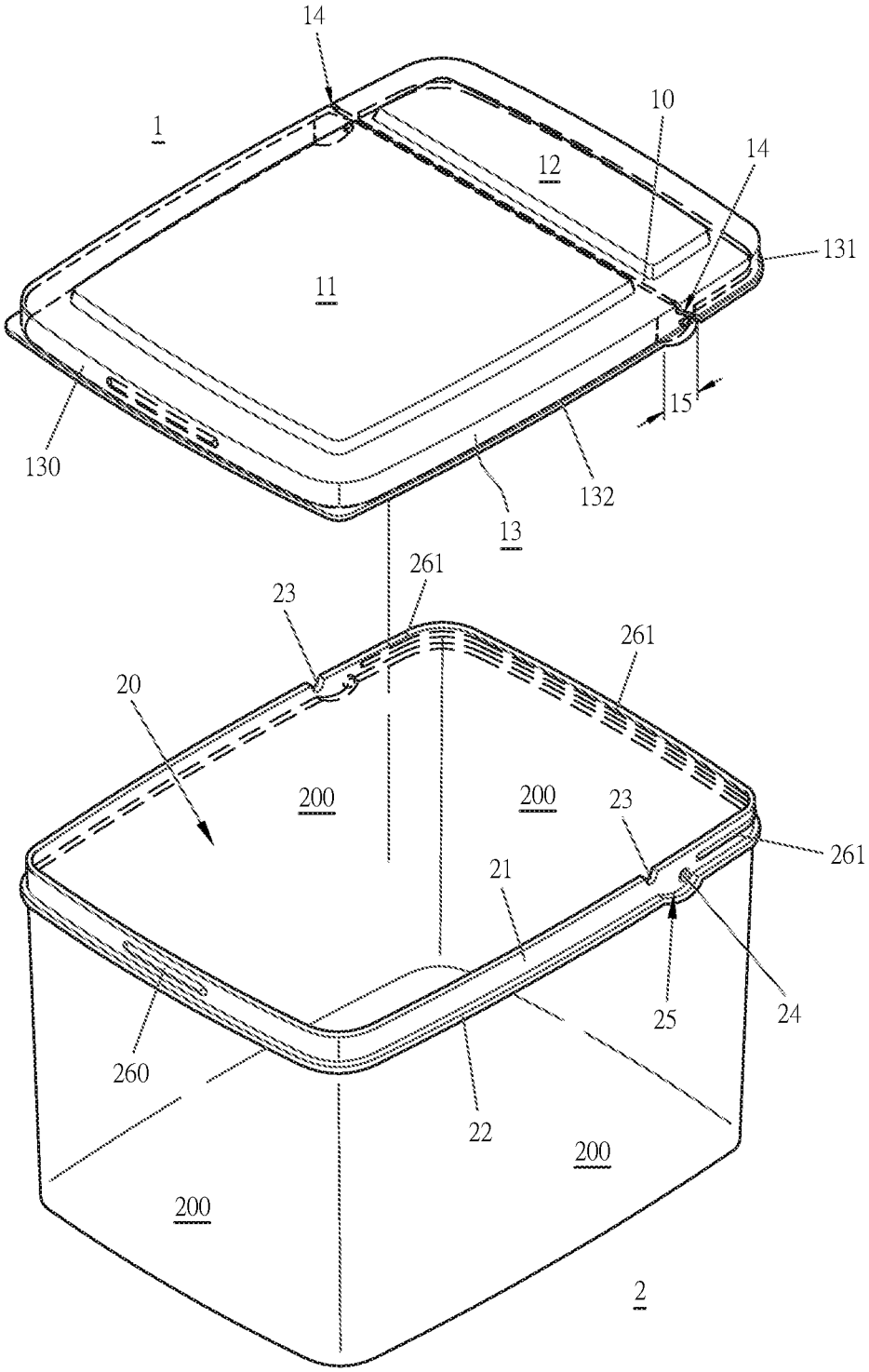
FIG. 1 is an exploded perspective view of the fastener container in the present invention.
Figure 2:
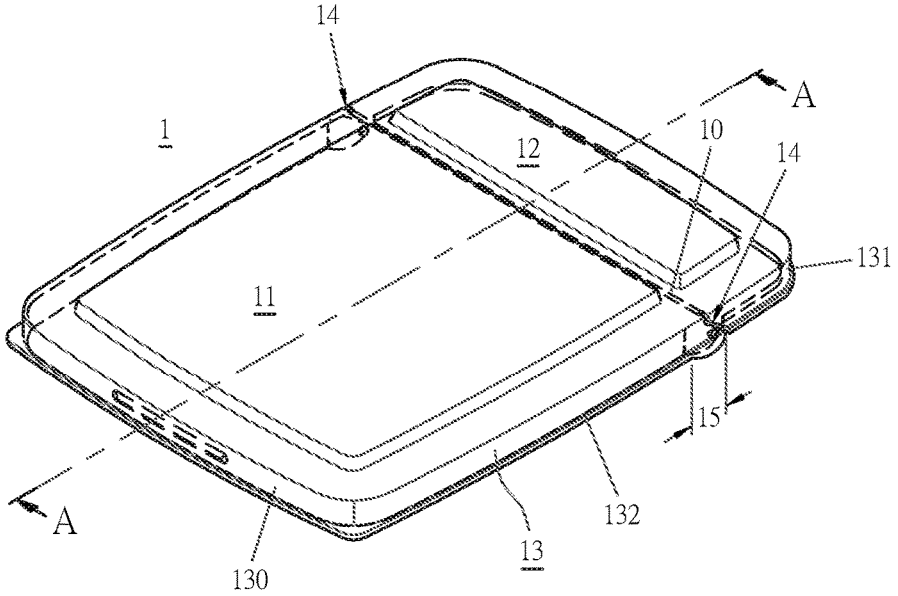
FIG. 2 is a three-dimensional view of the lid in the present invention.

A preferred embodiment of a fastener container in the present invention, as shown in FIG. 1~20, includes a lid 1 and a receptacle base 2 as main components combined together. The lid 1 and the receptacle base 2 can be made of plastic, rubber or other elastic material.

As shown in FIGS. 2 to 8, the lid 1 has a first section 11 and a second section 12 which are connected by a hinge 10. The size of the first section 11 may be greater than, equal to or less than the size of the second section 12 in accordance with the use requirement.

A side circumferential wall 13 is provided on the periphery of the lid 1, the side circumferential wall 13 is divided into a first circumferential wall 130 and a second circumferential wall 131 by two symmetrical oblique incision 14 extend from the end of the hinge 10 to the bottom of the side circumferential wall 13. A reinforced ring 132 is set on the bottom of said circumferential wall 13 to strengthen the structural strength of the side circumferential wall 13.

Figure 3:
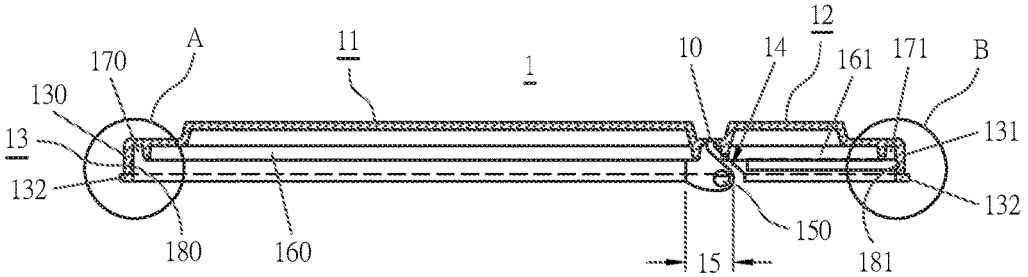
FIG. 3 is an enlarged sectional view of A-A shown in FIG. 2.
Figure 4:
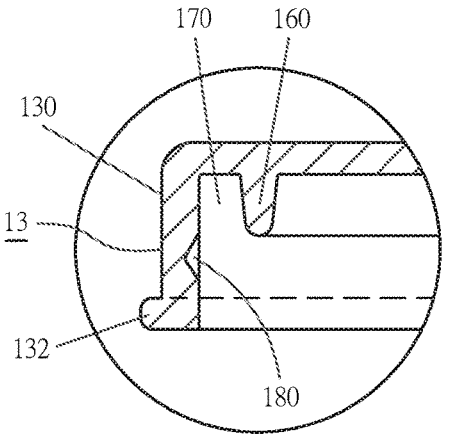
FIG. 4 is an enlarged view of area A shown in FIG. 3.
Figure 5:
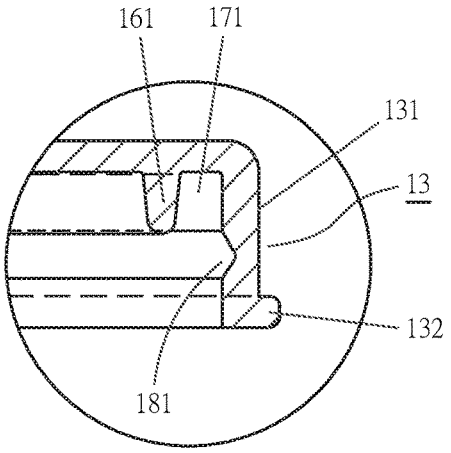
FIG. 5 is an enlarged view of area B shown in FIG. 3.

As shown in FIGS. 3 to 5, a first inner circumference 160 is provided inside the first circumferential wall 130 of the first section 11, and a first groove 170 is formed between the first circumferential wall 130 and the first inner circumference 160. A first recess 180 is set on the inner surface of said first circumferential wall 130. A second inner circumference 161 is provided inside the second circumferential wall 131 of the second section 12, and a second groove 171 is formed between the second circumferential wall 131 and the second inner circumference 161. A second recess 181 is set on the inner surface of said second circumferential wall 131. The total length of the first recess 180 may be less than or equal to the total length of the second recess 181, and the shape of the first recess 180 and the second recess 181 may be triangular. Said first groove 170 and second groove 171 are engaged with each other to form an annular groove.

Figure 6:
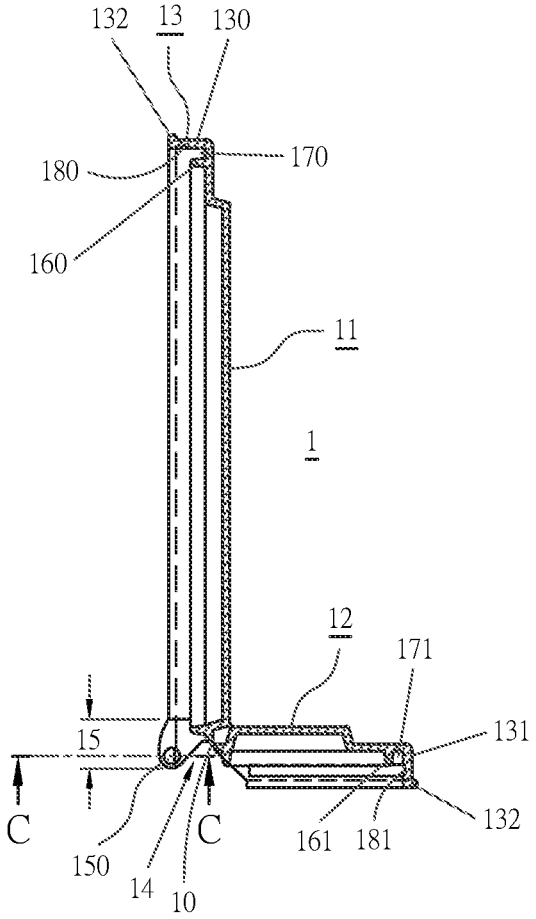
FIG. 6 is a fore side view of the lid in the present invention.
Figure 7:
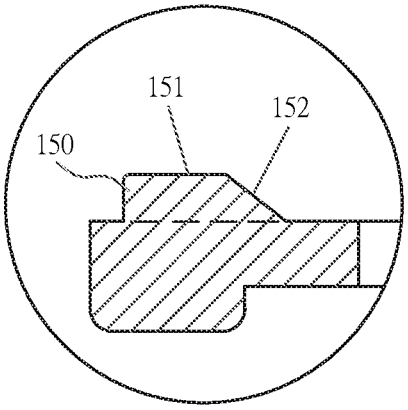
FIG. 7 is an enlarged sectional view of C-C shown in FIG. 6.
Figure 8:
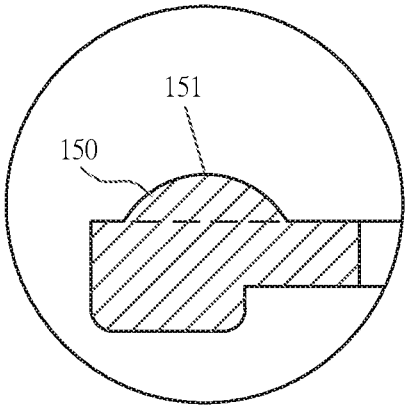
FIG. 8 is a partially enlarged view shown in FIG. 6.
Figure 9:
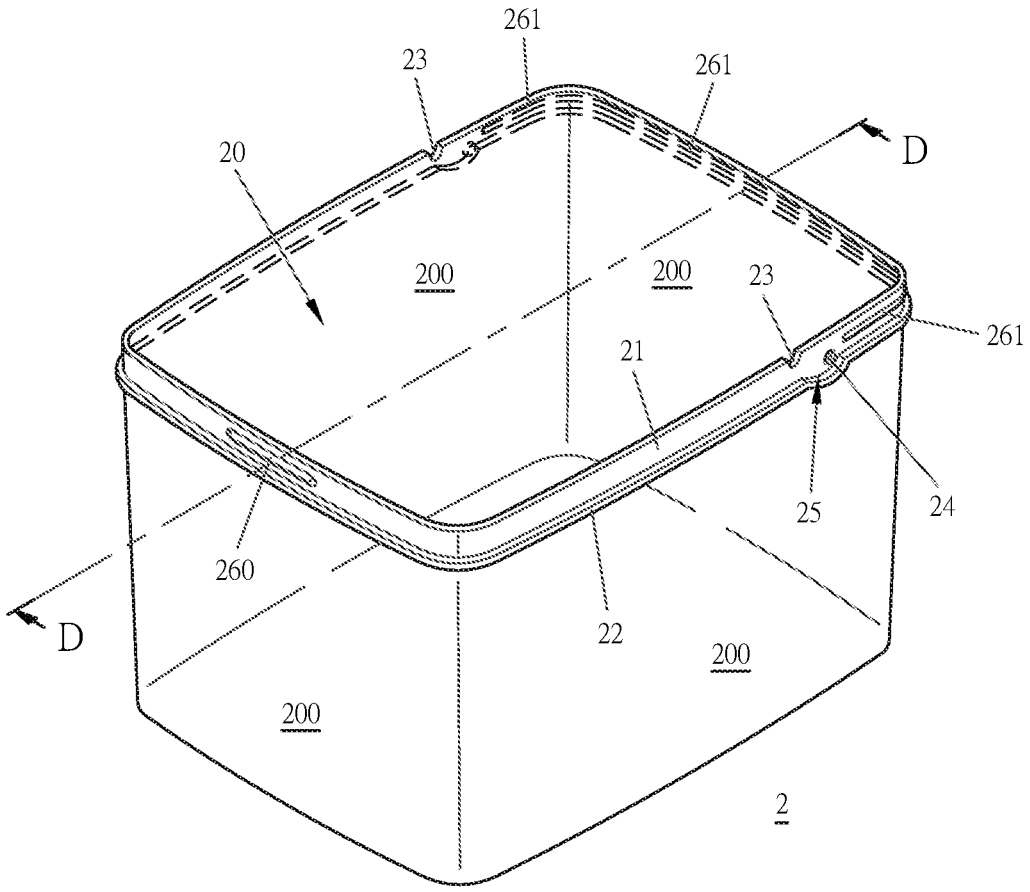
FIG. 9 is a three-dimensional view of the receptacle base in the present invention.

As shown in FIGS. 6 to 8, two engaging members 15 are separately provided on both ends of said first circumferential wall 130, and a positioning protrusion 150 is set on the inner surface of the end of each engaging member 15, the end 151 of the positioning protrusion 150 may be a convex surface (as shown in FIG. 8) or a flat (as shown in FIG. 7) and the side 152 of the positioning protrusion 150 may be an oblique plane (as shown in FIG. 7).

Figure 21:
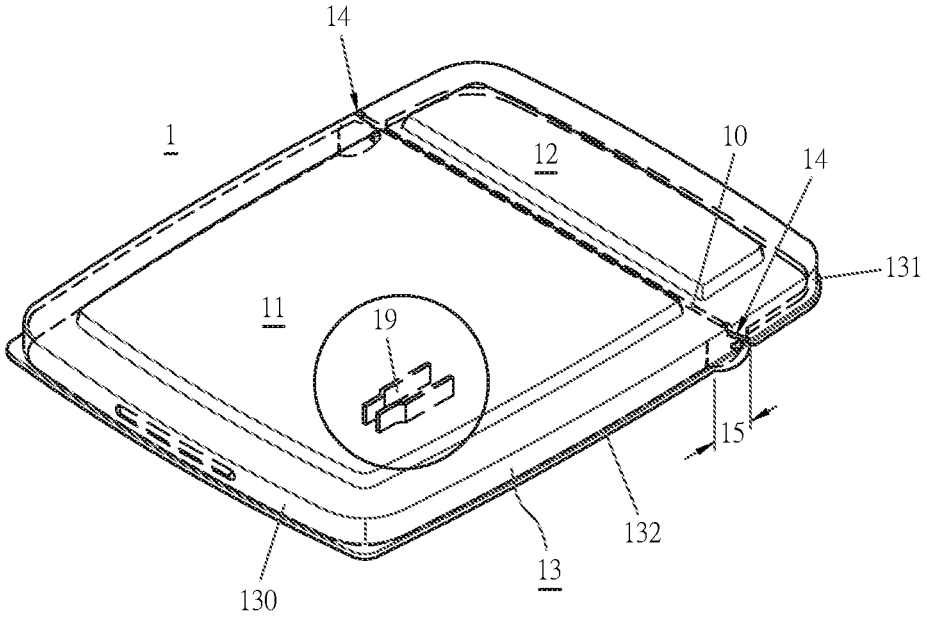
FIG. 21 is an perspective view of the lid with tool holders in the present invention.
Figure 22:
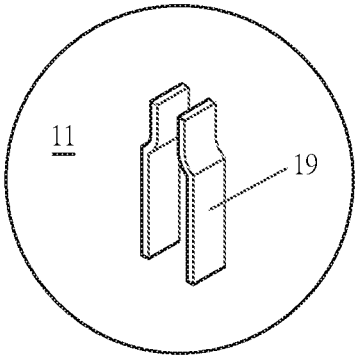
FIG. 22 is an enlarged view of the V-shape tool holder in the present invention.
Figure 23:
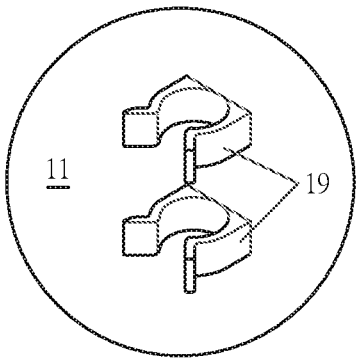
FIG. 23 is an enlarged view of the U-shape tool holder in the present invention.

As shown in FIGS. 21 to 23, the underside of the first section of the lid 1 may provided with various types of tool holders 19, such as V-shape holder or U-shape holder, to utilize the tool holders 19 to receive a variety of fastener tools.

As shown in FIGS. 9 to 14, said receptacle base 2 has a space 20 to contain screws or other items, the annular side wall 200 of the receptacle base 2 is provided in conformance with the shape of the lid 1. A engaging circumference 21 is set on the top of the receptacle base 2 and a protrudent ring 22 is provided between the annular side wall 200 and the engaging circumference 21 to strengthen the structure of the receptacle base 2 and to limit the final engaging position and depth of the lid 1. So that the user can know whether the lid 1 has been tight with the receptacle base 2.

Figure 10:
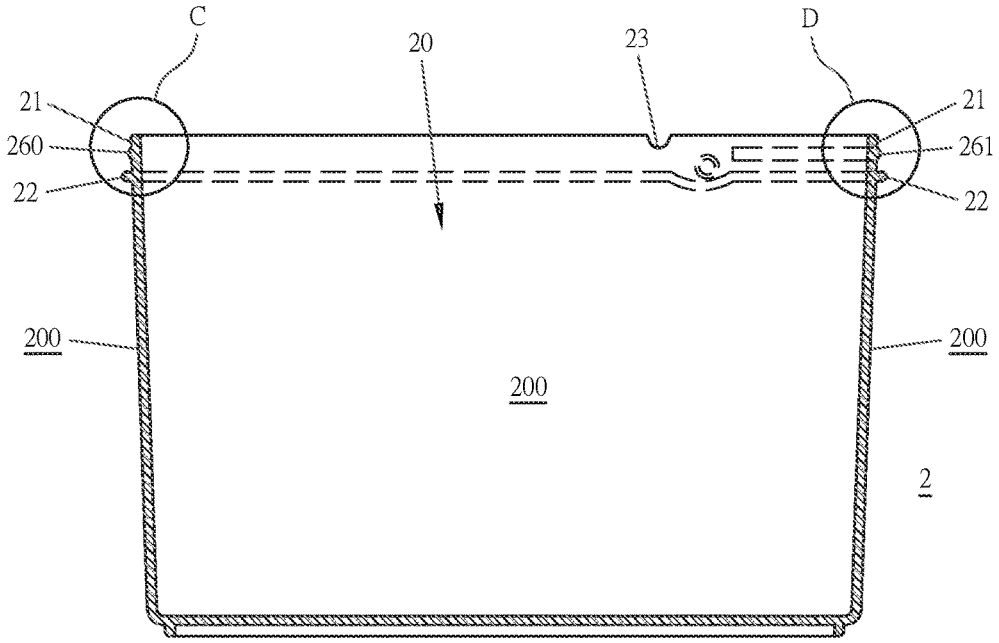
FIG. 10 is an enlarged sectional view of D-D shown in FIG. 9.
Figure 11:
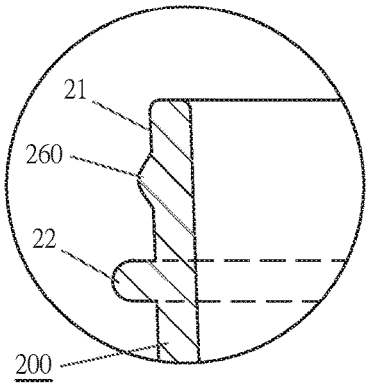
FIG. 11 is an enlarged view of area C shown in FIG. 10.
Figure 12:
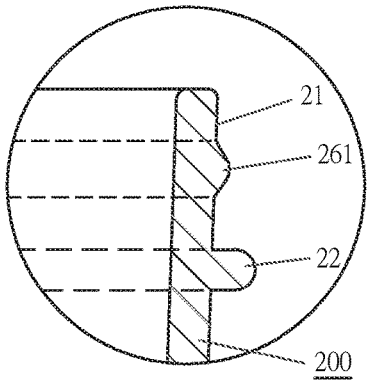
FIG. 12 is an enlarged view of area D shown in FIG. 10.

As shown in FIGS. 10 to 12, the front side of said engaging circumference 21 has a first engaging flange 260 which is provided to match with said first recess 180, and the rear side of said engaging circumference 21 has a second engaging flange 261 which is provided to match with said second recess 181. The total length of the first engaging flange 260 may be less than the total length of the second engaging flange 261, so that the first section 11 will be easier to open than the second section 12. The shape of the first engaging flange 260 and the second engaging flange 261 is corresponded to the shape of said first recess 180 and second recess 181.

Figure 13:
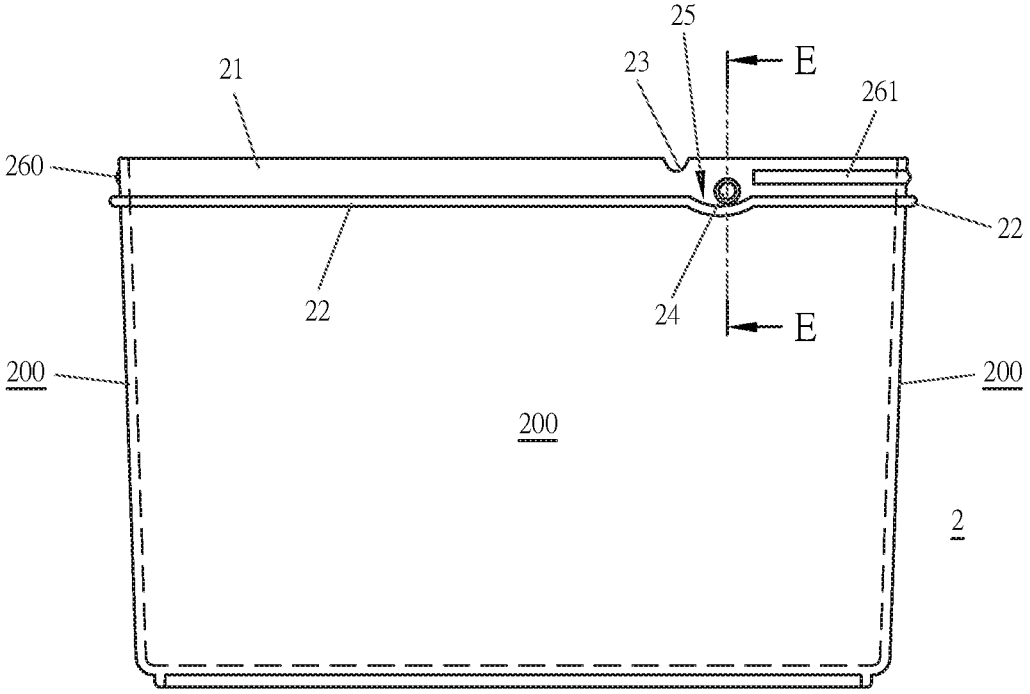
FIG. 13 is a side view of the receptacle base in the present invention.
Figure 14:
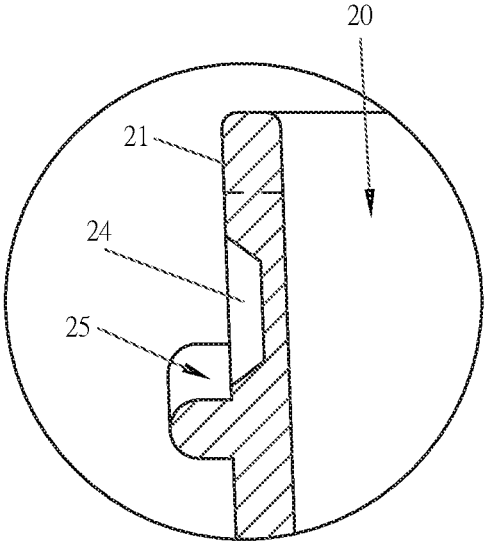
FIG. 14 is an enlarged sectional view of E-E shown in FIG. 13.
Figure 15:
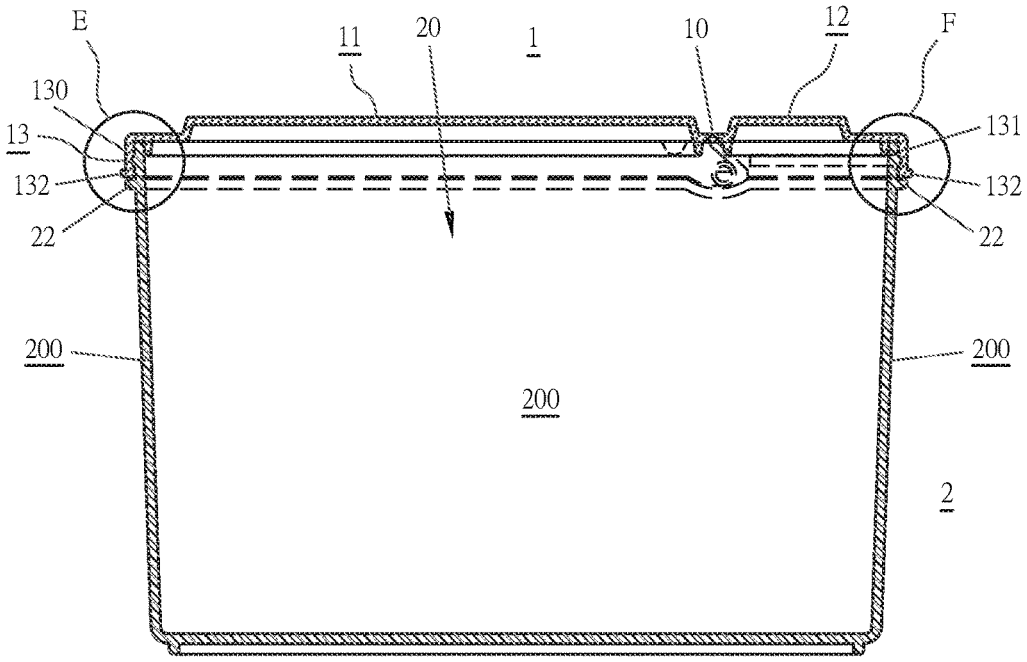
FIG. 15 is a sectional view of the fastener container in the present invention.
Figure 16:
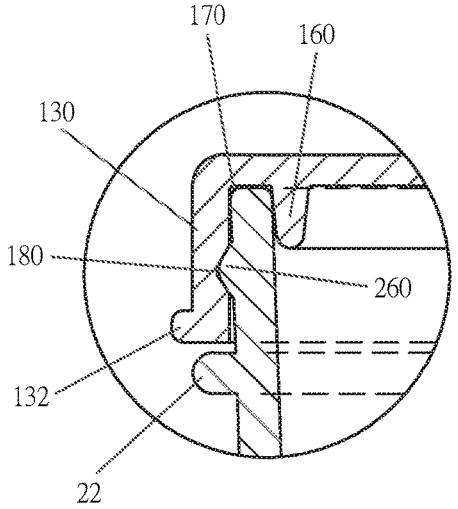
FIG. 16 is an enlarged view of area E shown in FIG. 15.
Figure 17:
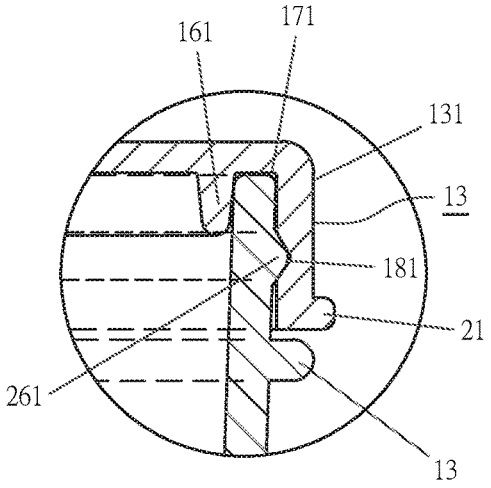
FIG. 17 is an enlarged view of area F shown in FIG. 15.

As shown in FIGS. 10, 13 and 14, a pair of first positioning notches 23 are symmetrically provided above the both sides of the engaging circumference 21, and at least one second positioning notch(s) 24 is/are separately provided on the rear side of each first positioning notch 23. The second positioning notches 24 and the first positioning notches 23 are arranged in arc, and the position of the first notch 23 is higher than the position of the second notch 24. The second positioning notch 24 is placed on the outer surface of the engaging circumference 21, and the plurality of second positioning notches 24 can let the first section 11 of lid 1 to be held in a variety of open angular. The both sides of the protrudent ring 22 may be provided with a pair of symmetrical arc-shaped grooves 25 which are separately placed below the first notch 23 and the second notch 24, if the protrudent ring 22 will affect the rotation of the engaging member 15 of the lid 1.

As shown in FIGS. 1, 15 to 17, when the lid 1 is engaged with the receptacle base 2, the first groove 170 and the second groove 171 of the lid 1, and the engaging circumference 21 of the receptacle base 2 are combined with each other. The first recess 180 of the first section 11 and the second recess 181 of the second section 12 are fitted to the first engaging flange 260 and the second engaging flange 261 of the receptacle base 2, respectively. And the positioning protrusions 150 of the engaging members 15 are fitted to the lowermost second notch 24 of the receptacle base 2. So that the lid 1 can be tightly engaged with the receptacle base 2.

Figure 18:
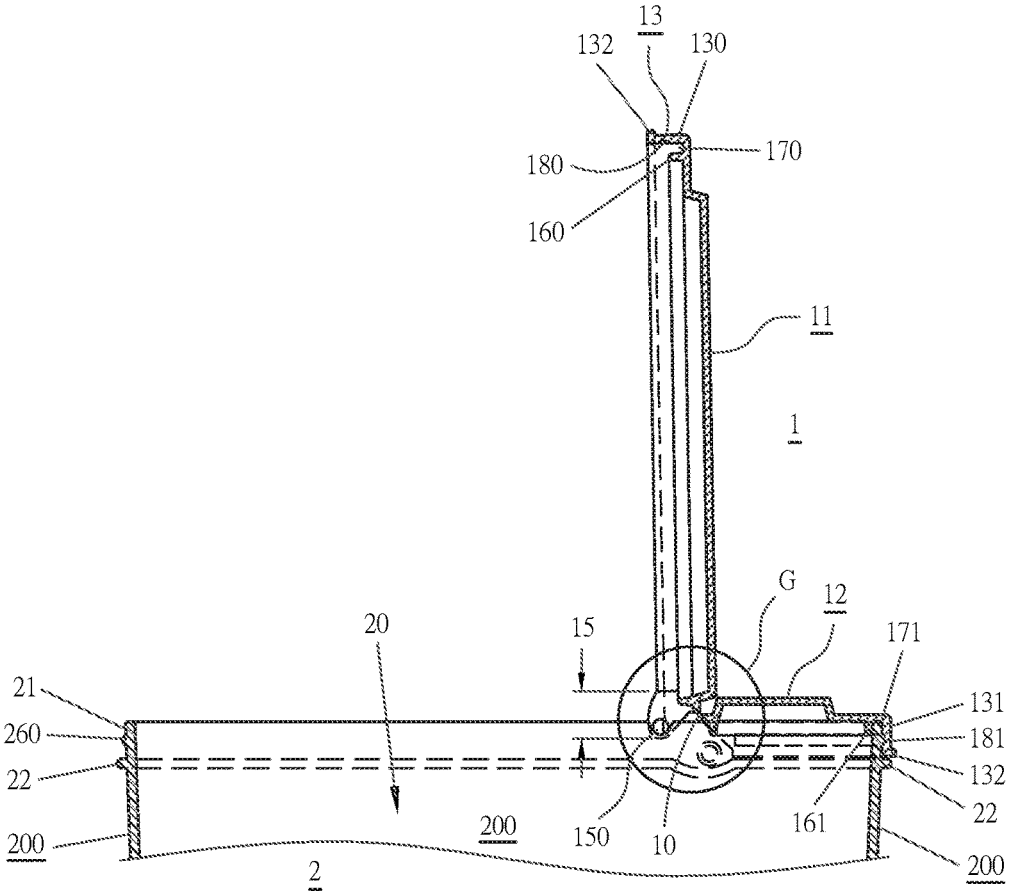
FIG. 18 is a partially enlarged sectional view of the fastener container in the present invention, wherein the front section of lid is in the open position.
Figure 19:
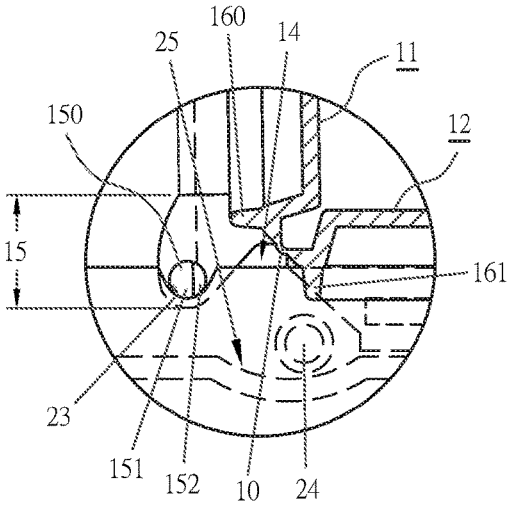
FIG. 19 is an enlarged view of area G shown in FIG. 18.
Figure 20:
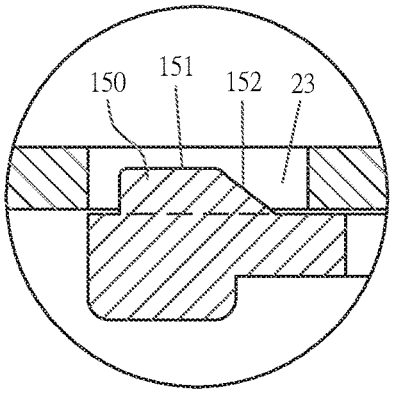
FIG. 20 is a partially enlarged sectional view of the fastener container in the present invention, wherein the side of the positioning protrusion is stuck against the first notch.

As shown in FIGS. 18 to 20, when the user wants to take or place the screws or items from the receptacle base 2, he/she can pull off the first section 11 of the lid 1 to separate the first recess 180 of the first section 11 from the first engaging flange 260 of the receptacle base 2, and then using the hinge 10 as the pivot to rotate the first section 11 upwards. In this moment, the positioning protrusions 150 of the engaging members 15 will be separated from the lowermost second notch 24 of the receptacle base 2, then the end of the engaging members 15 will rotate upwards along the arc-shaped groove 25 of the receptacle base 2. The user can select the desired open angle and move the positioning protrusions 150 to the other second notch 24 or the first notch 23, and the side 152 of the positioning protrusion 150 will be stuck against the second notch 24 or first notch 23, so that the first section 11 of the lid 1 can be held in the open position to facilitate the user to reach his/her hand into the receptacle base 2 to take or put the screws or other items.

On the contrary, if the user wants to close the first section 11 of the lid 1, he/she just need to depress the first section 11 of the lid 1 and separate the positioning protrusions 150 from the second notch 24 or first notch 23, and then moving the positioning protrusions 150 downward to the lowermost second notch 24, so that the first section 11 of the lid 1 and the receptacle base 2 can be restored to the tightly engaged state to prevent the screw or other items from falling out.

Therefore, this invention used the positioning protrusions 150 of the engaging members 15 of the lid 1, the first notch 23 and the second notch(s) 24 of the receptacle base 2 to allow the user to easily open or close the first section 11 of the lid 1, but also effortless to hold the first section 11 of the lid 1 in any open angle to allow the user to take or place screws or other items. Evidently this invention has tangible benefits and tallies with progressiveness and novelty demanded by patent laws.

While the preferred embodiments of this invention have been described above, it will be recognized and understood that various modifications may be made therein and appended claims are intended to cover all such modifications that may fall within the spirit and scope of the invention.

What is claimed is:

1. A fastener container at least comprising:

a lid having a first section and a second section which are connected by a hinge, wherein a side circumferential wall is provided on a periphery of the lid, the side circumferential wall is divided into a first circumferential wall and a second circumferential wall by two symmetrical oblique incisions extend from an end of the hinge to a bottom of the side circumferential wall; a first inner circumference is provided inside the first circumferential wall of the first section, and a first groove is formed between the first circumferential wall and the first inner circumference, a first recess is set on an inner surface of the first circumferential wall; a second inner circumference is provided inside the second circumferential wall of the second section, and a second groove is formed between the second circumferential wall and the second inner circumference, a second recess is set on an inner surface of the second circumferential wall; the first groove and the second groove are engaged with each other to form an annular groove; two engaging members are separately provided on both ends of the first circumferential wall, and a positioning protrusion is set on an inner surface of an end of each engaging member;

a receptacle base having a space, wherein an annular side wall of the receptacle base is provided in conformance with the shape of the lid, an engaging circumference is set on a top of the receptacle base; a front side of the engaging circumference has a first engaging flange which is provided to match with the first recess, and a rear side of the engaging circumference has a second engaging flange which is provided to match with the second recess; a pair of first positioning notches are symmetrically provided above both sides of the engaging circumference, and at least one second positioning notch is separately provided on a rear side of each first positioning notch; the second positioning notches and the first positioning notches are arranged in an arc, and a position of the first notch is higher than a position of the second notch; the second positioning notch is placed on an outer surface of the engaging circumference.

2. The fastener container according to claim 1, wherein a protrudent ring is provided between said annular side wall and engaging circumference to strengthen the structure of the receptacle base and to limit the final engaging position and depth of the lid.

3. The fastener container according to claim 2, wherein a pair of symmetrical arc-shaped grooves are provided on both sides of said protrudent ring, said arc-shaped grooves is placed below the first notch and the second notch.

4. The fastener container according to claim 1, wherein a reinforced ring is set on the bottom of said circumferential wall to strengthen structural strength of the side circumferential wall.

5. The fastener container according to claim 1, wherein the end of the positioning protrusion is a convex surface.

6. The fastener container according to claim 1, wherein the end of the positioning protrusion is a flat surface, and a side of the positioning protrusion is an oblique plane relative to a vertical axis of the positioning protrusion.

7. The fastener container according to claim 1, wherein a cross-section of said first recess and second recess is of a triangular shape, and the shape of a cross-section of said first engaging flange and second engaging flange is corresponded to the shape of the cross-section of said first recess and second recess.

8. The fastener container according to claim 1, wherein the total length of the first engaging flange is less than the total length of the second engaging flange, so that the first section will be easier to open than the second section.

9. The fastener container according to claim 1, wherein the at least one second positioning notch can let the first section of lid to be held in a variety of open angular.

10. The fastener container according to claim 1, wherein the lid and the receptacle base are made of plastic or rubber.

11. The fastener container according to claim 1, wherein the underside of the first section of the lid is provided with tool holder(s).

12. The fastener container according to claim 1, wherein said tool holders are a V-shape holder.

13. The fastener container according to claim 1, wherein said tool holders are a U-shaped holder.

* * * * *